United States Patent [19]

Gillis

[11] 4,225,180

[45] Sep. 30, 1980

[54] COLLAPSIBLE CHAIR

[76] Inventor: Robert E. Gillis, P.O. Box 67, Aptos, Calif. 95003

[21] Appl. No.: 960,244

[22] Filed: Nov. 13, 1978

[51] Int. Cl.[2] ..... A47C 3/02; A47C 7/00

[52] U.S. Cl. ..... 297/258; 297/442

[58] Field of Search ..... 297/258, 442, 443

[56] References Cited

U.S. PATENT DOCUMENTS

| | | | |
|---|---|---|---|
| 1,747,900 | 2/1930 | Jenny | 297/442 |
| 2,486,987 | 11/1949 | Scarlett | 297/442 |
| 2,518,955 | 8/1950 | Stelzer | 297/442 |
| 3,460,866 | 8/1969 | Kessel | 297/258 |

*Primary Examiner*—James C. Mitchell

*Attorney, Agent, or Firm*—Robert G. Slick

[57] ABSTRACT

A collapsible chair is provided which can be easily fabricated from a sheet material such as plywood. The chair consists of two rocker elements, a seat and a back. The four elements can be stored and shipped flat and easily erected into chair form without the use of tools or fastening elements.

3 Claims, 5 Drawing Figures

COLLAPSIBLE CHAIR

SUMMARY OF THE INVENTION

The present invention relates to a collapsible chair which is easily fabricated from a sheet material such as plywood.

The chair of the present invention can be stored and shipped flat so that it occupies little space. Thus, it is ideal for a number of purposes where one wishes to have a chair which can serve the purpose of a normal rocking chair, yet which can be stored in little space. For instance, it finds use in the home as an occasional chair where the chair can be stored in a very small space when not needed but which can be quickly erected when required. Another typical use of such a chair is on a camping trip where space is limited where a small flat article can be easily stowed away while a normal chair would occupy an inordinate amount of space.

The chair of the present invention is preferably fabricated from plywood, although it will be obvious that any strong, thin sheet material can be used.

DESCRIPTION OF THE PREFERRED EMBODIMENT

Figure 1:
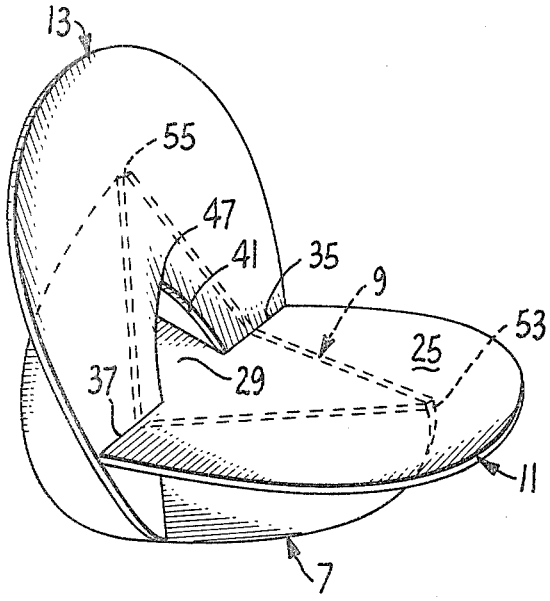
FIG. 1 is a perspective view of a chair embodying the present invention.
Figure 3:
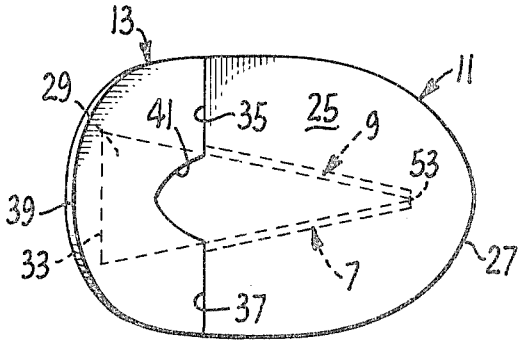
FIG. 3 is a top view of the erected chair.

Referring now to the drawings by reference characters, the chair of the present invention consists of four main parts, namely two identical rocker elements, generally designated 7 and 9, a seat 11, and a back 13.

Figure 4:
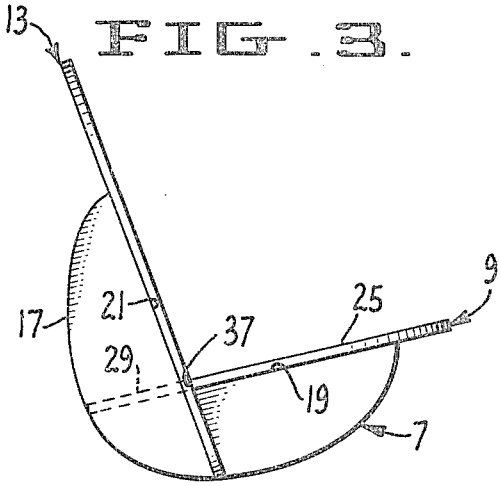
FIG. 4 is a side view of the chair.

Since the rocker elements 7 and 9 are mirror images of each other, only one is described in detail. Thus, referring specifically to the rocker element 7, it has a rounded bottom portion 15 which is of the usual configuration of a chair rocker. It also has a back portion 17 and this is shown rounded but it is obvious that this is merely for aesthetics and that the exact shape of the back 17 is not a functional part of the invention. Opposite the rocker and the back elements is a flat, seat-supporting section 19 and a back-supporting section 21. These two flat portions, 19 and 21, are so arranged so as to give the chair a comfortable seating angle and this angle is normally a little over 90°, as is best seen in FIG. 4. An angle from 100° to 100° is satifactory. Extending downwardly from the back portion 21 is a slot 23 which extends about half way from the rocker portion 15 and the seat-supporting element 19.

The seat portion, generally designated 11, has a large flat expanse 25 of a suitable size for a seat. The front portion 27 is shown as rounded but it will be apparent that this is merely a shape which is aesthetically pleasing and which is not functional. Thus, the front portion 27 could be straight across without changing the function of the chair. At the rear of the seat is a tail-like extremity 29 in the shape of the keystone with the smaller portion of the keystone 31 adjacent seat portion 25 and the outer extremity 33, which is of course wider than 31, extending away from the seat. At either side of the keystone portion are the straight portions 35 and 37.

The back 13 is shown with a generally rounded top 39 but here again, this is merely for the purpose of aesthetics and it could be rectangular or of any desired configuration. In the back portion, is a triangular cutout 41 wherein the bottom of the cutout, designated 43, is a straight line and is roughly the same width as the narrow portion of the keystone 31. Extending downwardly from the base 43 of the triangle is a slot 45 and the distance from the bottom of this slot 45 to the apex of the triangular cutout 41, which is designated 47, is substantially equal to the widest portion of the keystone 33.

At the base of the back portion are two slots 49 and 51 and these are complementary to the slots 23 in the rocker portions 7 and 9.

Figure 2:
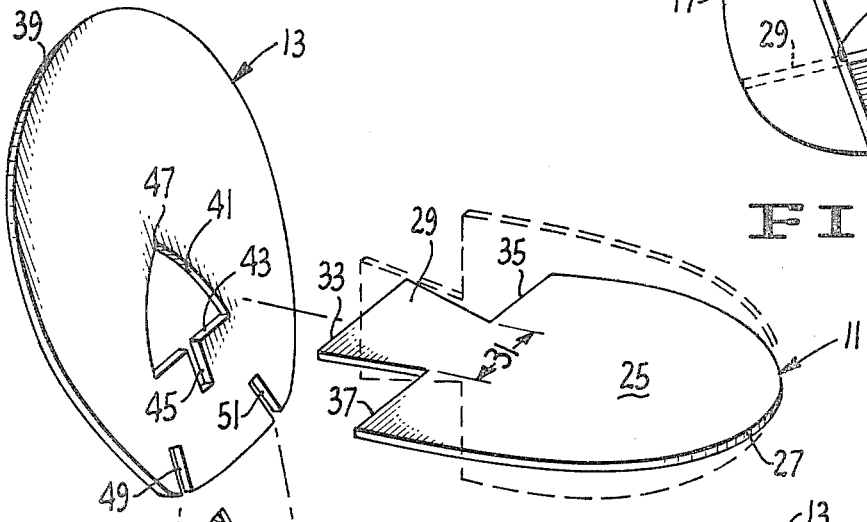
FIG. 2 is an exploded view showing the steps which one goes through in erecting the chair.
Figure 2:
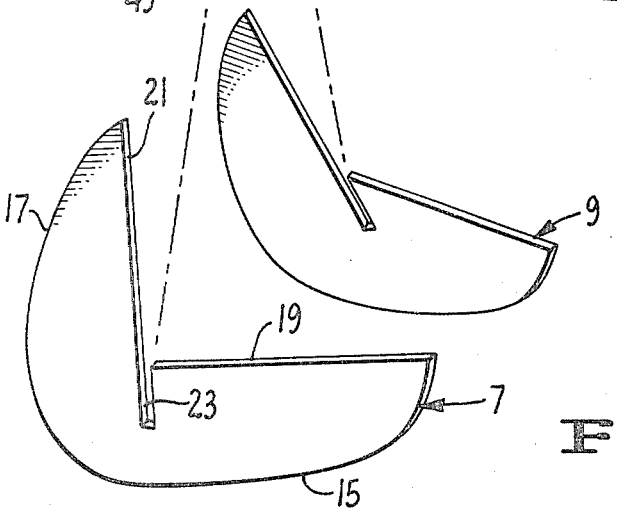
Figure 5:
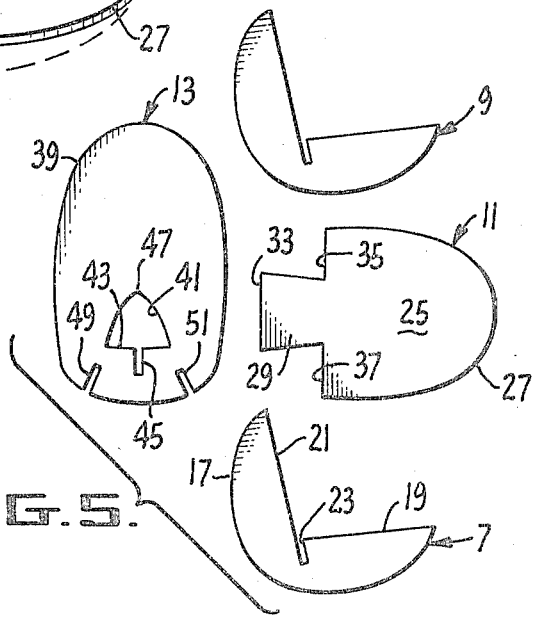
FIG. 5 is a view, on a reduced scale, of the four individual pieces which are used for the chair.

In order to erect the chair of the present invention, one takes the seat portion, generally designated 11 and turns it 90°, i.e. to the position shown in dash lines in FIG. 2 and inserts the keystone through the opening in the back. When the keystone is fully inserted, i.e. the flat sides 35 and 37 in contact with the back, one can now turn the seat 11 back to the usual position for the seat, i.e. the position shown in the solid lines in FIG. 2. The rocker elements 7 and 9 are now placed in a generally upright position and the back 13 is placed with its large flat portion in contact with the flat back portion 21 and with the slots 49 and 51 extending downwardly into the slots of the rockers. The seat is then pushed firmly down onto the surfaces 19. The chair is now completely assembled.

In a preferred embodiment of the invention, slots 23 and 49 are so configured that the extremities of the rocker portions, i.e. as is shown at 53 and 55 in FIG. 1 are brought together into contact with each other, greatly increasing the stability of the chair.

The chair of the present invention is fabricated of a stiff, sheet material such as plywood or plastic. The sections have been shown as solid, but might have cutouts to save weight and/or cost.

I claim:

1. A chair which is composed of a flat sheet material such as plywood which can be stored and shipped as a flat package and which can be easily erected to chair form without the use of tools or fastening elements, said chair comprising four pieces as follows:

a. Two rocker elements, each of said elements having a rounded bottom portion, serving as a rocker for contact with the floor and a back portion extending upwardly therefrom and a cutout portion opposite said rounded bottom portion and said back portion, said cutout including two straight walls inclined at an angle of slightly over 90° to each other, namely a seat-supporting section 19 opposite said rounded bottom portion and a back-supporting section 21, and a slot extending downward from the back portion at the junction of the seat-supporting section and the back-supporting section, b. A seat adapted to fit over said rocker and terminating in a tail-like extremity in the shape of a keystone with the large portion of the keystone away from the balance of the seat, c. A back portion having an opening in the center large enough to allow the large portion of the keystone of the tail to pass through the opening when the seat is in a vertical plane and to fit snugly with the small portion of the keystone when the seat is in a horizontal plane preventing the seat from rising up and having a pair of slots on the bottom of the back portion, said slots being complementary to the slots in said rocker elements whereby: the seat portion can be turned 90° from normal; the keystone portion inserted in the slot in the back portion and turned to normal seat position to rest on the rocker portion and said rocker elements can be placed on the floor with the bottom portion of each rocker resting on the floor; the back portion placed over the rocker elements with the slots of the back extending into and beyond the slots of the rocker elements.

2. The structure of claim 1 wherein the front of the seat and the top of the back have a rounded configuration.

3. The structure of claim 1 wherein the mating slots in the two rocker elements and the back portion are inclined at an angle so that the two extremities of the two rocker elements are held in contact with each other.

* * * * *